United States Patent [19]

Koester et al.

[11] Patent Number: 4,702,391

[45] Date of Patent: Oct. 27, 1987

[54] CONTAINMENT WITH LONG-TIME CORROSION RESISTANT COVER FOR SEALED CONTAINERS WITH HIGHLY RADIOACTIVE CONTENT

[75] Inventors: Rainer Koester, Karlsruhe; Emanuel Smailos; Werner Schwarzkopf, both of Eggenstein-Leopoldshafen; Arthur Kiesow, Dueren, all of Fed. Rep. of Germany

[73] Assignee: Kernforschungszentrum Karlsruhe GmbH, Karlsruhe, Fed. Rep. of Germany

[21] Appl. No.: 795,846

[22] Filed: Nov. 7, 1985

[30] Foreign Application Priority Data

Dec. 22, 1984 [DE] Fed. Rep. of Germany ..... 3447278

[51] Int. Cl.[4] ..... G21F 5/00

[52] U.S. Cl. ..... 220/456; 376/272; 250/507.1

[58] Field of Search ..... 376/272; 250/506.1, 250/507.1; 252/629, 633; 220/456, 453

[56] References Cited

U.S. PATENT DOCUMENTS

| | | | |
|---|---|---|---|
| 3,179,243 | 4/1965 | Ashcroft | 376/272 |
| 3,754,140 | 8/1973 | Beierle | 250/507.1 |
| 3,962,587 | 6/1976 | Dufrane et al. | 376/272 |
| 4,209,420 | 6/1980 | Larker | 376/272 |
| 4,326,918 | 4/1982 | Lapides | 252/629 |
| 4,488,990 | 12/1984 | Yannopoulos | 252/629 |
| 4,527,065 | 7/1985 | Popp et al. | 376/272 |
| 4,532,104 | 7/1985 | Wearden | 376/272 |
| 4,569,818 | 2/1986 | Popp et al. | 376/272 |
| 4,572,959 | 2/1986 | Popp et al. | 376/272 |
| 4,596,688 | 6/1986 | Popp | 376/272 |

FOREIGN PATENT DOCUMENTS

| | | | |
|---|---|---|---|
| 0084840 | 8/1983 | European Pat. Off. | 376/272 |
| 0111231 | 6/1984 | European Pat. Off. | 376/272 |
| 2311162 | 9/1974 | Fed. Rep. of Germany | 250/506.1 |
| 3306970 | 8/1984 | Fed. Rep. of Germany | 376/272 |
| 3321250 | 12/1984 | Fed. Rep. of Germany | 250/506.1 |
| 0022700 | 2/1985 | Japan | 252/629 |

*Primary Examiner*—Deborah L. Kyle
*Assistant Examiner*—Daniel Wasil

[57] ABSTRACT

A containment with a long-time corrosion resistant protective cover for a container with highly radioactive content consists of a thick-walled metallic containment cylinder having a bottom and lid mounted at its bottom and upper ends completely surrounded and sealed in by corrosion protective linings and layers to prevent corrosion damage. Additionally, cover and bottom plates are mounted on the lid and the bottom, respectively, which plates have diameters larger than those of the containment cylinder and the lid and bottom in order to prevent mechanical damage to the corrosion protective layers and liners of the containment.

6 Claims, 2 Drawing Figures

CONTAINMENT WITH LONG-TIME CORROSION RESISTANT COVER FOR SEALED CONTAINERS WITH HIGHLY RADIOACTIVE CONTENT

BACKGROUND OF THE INVENTION

The invention relates to a containmant with a long-time corrosion resistant protective cover for tightly sealed containers with highly radioactive content such as steel containers enclosing radioactive waste molten into glass or burnt-out fuel elements of nuclear reactors.

The invention also is concerned with the manufacture of a mechanically, chemically and thermally stable packaging including a safe barrier for the isolation of environmentally dangerous materials in geologic formations. It is concerned in this connection with the final storage of highly radioactive waste encased in molten glass in deep bore holes of salt formations.

Highly radioactive glass-encased waste has not yet been placed into final storage. The packaging used so far for highly radioactive waste materials does not fulfill the barrier requirements for long-time isolation in final storage locations.

The barrier systems presently employed, which include outer corrosion protection, have the following disadvantages:

The corrosion protective enclosure is not in full contact with the steel container which forms the structure resistant to mechanical damage. The enclosure is therefore subject to damage as a result of thermal expansion or by exposure to outer forces as they may be caused by collapse of the storage bore. The enclosure is especially sensitive in areas where it is not in contact with the container, as adjacent the lid and cylinder section of the container and adjacent the bottom and cylinder section of the container.

With this kind of corrosion protection, which is applied in the form of a protective layer, welding of narrow-groove joints must be performed under cover gas in order to provide for weld seam quality with regard to corrosion resistance which is comparable with non-welded corrosion protective structures. However, sufficient cover gas protection cannot be guaranteed under the given conditions. The requirements for a corrosion protection structure which is tightly joined to the inner steel container and which permits good cover gas flushing of the weld joint are actually opposing one another. Stacking of such containmants in a drill hole causes crevice corrosion problems since the corrosion protective structure of one container comes in direct contact with the corrosion protective structure of the container stacked on top. If a grapping structure is arranged above the containers they cannot accept the load upon stacking. Also the provision of a grapping structure represents a weak point for the containment as far as corrosion protection is concerned. Fixing of such a containment in a transport container in which the lid and the bottom of the containment are at the same time top and bottom of a radiation shielding structure is not possible without adversely affecting the corrosion protection means.

It is the object of the present invention to provide a long-time corrosion protection enclosure for containments with highly radioactive content which does not have the disadvantages referred to above and which insures safe enclosure of the highly radioactive materials over a long period of time.

SUMMARY OF THE INVENTION

Such safe enclosure is insured by a containment with a long-time corrosion resistant protective cover for a container which retains the highly radioactive content. The containment consists of a thick-walled metallic containment cylinder having a bottom and lid mounted at its opposite lower and upper ends for closing the containment cylinder. The containment cylinder and the bottom and lid are fully surrounded and sealed-in by corrosion protective linings and layers which are preferably explosion welded onto the cylinder and the bottom and lid surfaces.

Additionally there are provided cover and bottom plates which are joined to the lid and bottom, respectively, and have diameters larger than the containment cylinder and the lid and bottom so that they project radially to thereby prevent mechanical damage to the corrosion protective layers and liners especially when the containment is lowered into a deep hole drilled into the ground for the reception of the containment for long-term storage of the radioactive materials therein.

Packaging of radioactive material in accordance with the present invention fulfills optimally all the requirements for corrosion protection and also for mechanical, thermal and chemical stability postulated for final storage in deep bore holes of salt formations.

The disadvantages of prior art arrangements are avoided, especially by the following features:

A lining of corrosion resistant material such as a titanium-palladium alloy is tightly applied by outside explosion plating. This avoids the requirement for flushing with protection gases at the weld seams and certainly provides for a tight fit of the corrosion protective linings. Maximum surface quality of the closure seams is obtained by electron beam welding in a vacuum and subsequent application of an outer smooth weld bead. The omission of the use of undesirable gases as well as the high surface quality of the weld seam substantially increase corrosion resistance.

The bottom and the cover lid of the containment are essentially identical and therefore may be welded with identical welding parameters. The bottom closure seam which, after welding, is still accessible may therefore be utilized as a measure for the quality control of the cover lid welding seam which is applied remotely under hot cell operating conditions. The top and bottom steel plates which are welded onto the container have a diameter which is somewhat larger than the bottom and top ends of the container and are provided with corrosion protection such as a layer of a titanium-palladium alloy which is applied by explosion plating. The arrangement permits stacking of the containers in an end storage bore without fission corrosion problems and without the occurrence of tension concentration points at the corrosion protection structure. The bottom and top steel plates with the corrosion protective layers explosion welded to one side thereof which are welded to the container also permit fixation of the whole enclosure in a transport container without adverse effects for the corrosion protection. The arrangement is the same at the top and bottom of the transport container. A gripping structure formed by a recess in the top plug structure permits stacking of the containments in final storage bores.

SHORT DESCRIPTION OF THE DRAWINGS

FIG. 1 is a cross-sectional view of the containment with the container disposed therein; and FIG. 2 is a partial view showing in cross-section the area A as encircled in FIG. 1, which area is essentially the same at the bottom and the top of the containment.

DESCRIPTION OF THE PREFERRED EMBODIMENT

Figure 1:
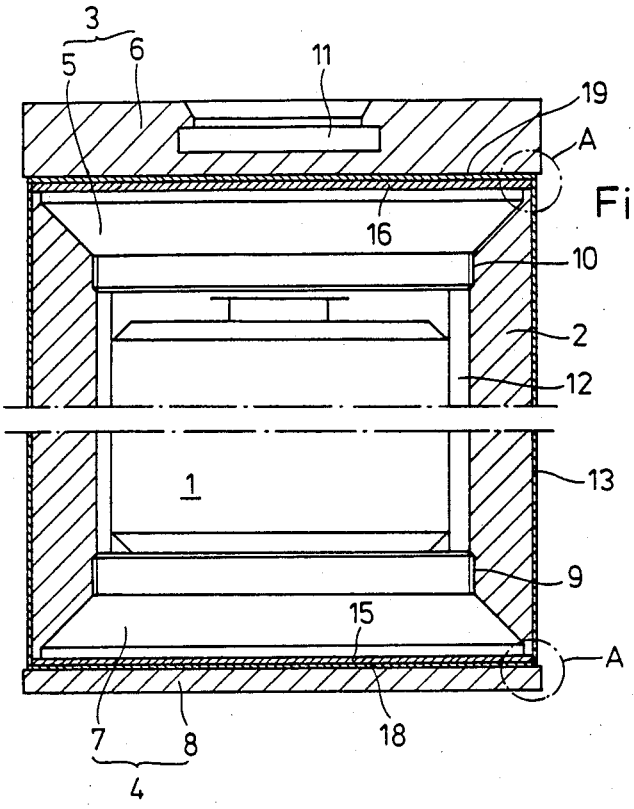
Figure 2:
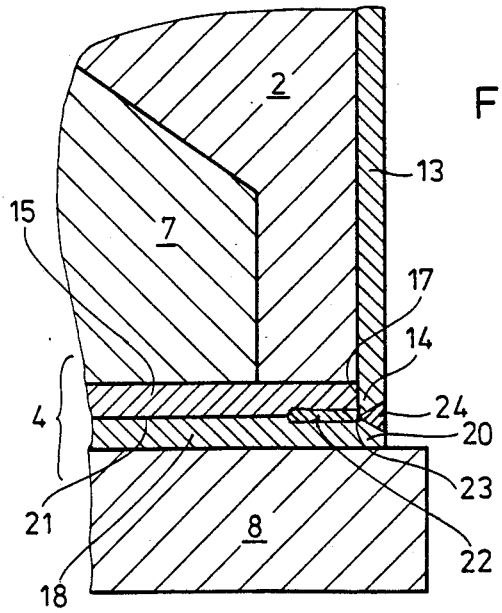

A container 1 enclosing solidified melted material with highly radioactive content is disposed in a hollow circular containment cylinder 2 which is closed at its bottom by a bottom plug structure 4 and at its top by a top plug structure 3. Together these parts form a containment. Both plugs 3 and 4 are mounted to the cylinder 2 by means of threads 9 and 10. The top plug structure 3 consists of a lid 5 and a cover plate 6; the bottom plug structure 4 consists of a bottom 7 and a bottom plate 8, the bottom plate 8 and the cover plate 6 having a diameter slightly larger than the bottom 7 and the lid 5, so that they both project slightly radially outwardly. Lid 5 and cover plate 6, as well as bottom 7 and bottom plate 8, are mounted together in a special way as shown in FIG. 2.

The containment cylinder 2, the lid 5, the cover plate 6, the bottom 7 and the bottom plate 8 all consist of fine-grain construction steel. The cover plate 6 has a gripping cavity 11 formed therein for engagement thereof by a lifting mechanism. The containment cylinder 2 has disposed therein around the body 1 a heat conductive centering sleeve 12 adapted to improve the heat transfer from the body 1 to the containment cylinder walls.

The containment cylinder 2 is provided, by explosion plating, with a liner 13, for example, of titanium-palladium alloy, providing a corrosion protective barrier which extends axially beyond its bottom and top ends such that it forms axial projections 14 of a length about equal the thickness thereof. This projection 14 serves as a centering means for the top and bottom plug structures 3 and 4.

The bottom 7 and the lid 5 are also provided, by explosion plating, with liners of the titanium-palladium alloy. The liners 15, 16 have about the same thickness as the liner 13. They project radially slightly beyond the bottom 7 or the cover 5 and have a diameter essentially corresponding to the inner diameter of the liner 13. When the bottom and top plug structures are mounted, the liners' 15 and 16 circumferential faces 17 are disposed adjacent the inner circumference of the projections 14 of the cylinder's outer liner 13.

Additional titanium-palladium layers 18, 19 of the same thickness are explosion welded onto the inner sides of the cover plate 6 and the bottom plate 8. As may be seen from FIG. 2, where the layer 18 of the bottom plate 8 is shown in greater detail, the radius of this layer 18 is larger than that of the liner 15 of the bottom 7 by about a layer's thickness. The projection 20 so formed is disposed adjacent the projection 14 of the cylinder liner 13 and is flush therewith when the bottom plug is mounted.

The arrangement at the top end of the containment is essentially the same, that is, the layer arrangement is identical and so is the welding procedure for the layers to be described below.

The bottom plate 8 and the bottom 7 and also the cover plate 6 and the lid 5 are welded together before the bottom and top plug structures are threaded into the containment cylinder 2. For this purpose bottom plate 8 and bottom 7 and also cover plate 6 and lid 5 are placed together such that liner 15 and layer 18 and also liner 16 and layer 19 are disposed adjacent one another. They are then welded together at the separating seam 21 by a circumferential weld 22, which is formed by electron beam welding and which extends between the plating liners and layers to a depth of up to 15 mm. When the top and bottom plugs 3, 4 are now threaded into the containment cylinder 2, the liner 13 with its projection 14 overlaps the liner 15 and abuts the layer 18 and forms an additional seam 23 between the projections 14 and 20. This seam 23 is now also welded by means of a circumferential weld 24 which is formed as a smooth cosmetic weld such that the lid 5, the bottom 7 and the containment cylinder 2 are completely surrounded by explosion welded layers and liners of the titanium-palladium alloy with sections of normal steel such as the bottom plate 8 and the cover plate 6 being disposed adjacent the corrosion protection layers below the bottom 7 and above the lid 5.

The corrosion protection liners and layers 13, 15, 16, 18, 19 therefore completely surround the containment 2, 3, 4. At the top and bottom end faces there are the cover plates 6 and 8 which consist of a material different from that of which the corrosion protection liners and layers consist and which have a diameter slightly larger than that of the containment cylinder 2. The bottom and cover plates consist of the same fine-grain construction steel as the containment cylinder walls 2, the bottom 7 and the lid 5 onto which the corrosion protection liners and layers are explosion welded. At the separating seam 21 the corrosion protection liners and layers 15, 18 and 16, 19 of the lid 5 and cover plate 6 and of the bottom 7 and the bottom plate 8, respectively, are welded together radially from the circumference thereof. The explosion welded layers 18, 19 of the bottom and cover plates 8, 6 have a larger diameter than the explosion welded liners 15, 16 of the bottom 7 and the lid 5; the liner 13 which is explosion welded onto the containment cylinder 2 has projecting end portions 14 which overlap the liners 15, 16 of the bottom 7 and the lid 5 and which are tightly welded from the outside, that is, circumferentially to the larger diameter layers 18, 19 of the bottom and cover plates 8, 6.

For the manufacture of the sealed containment according to the invention, the manufacturing steps are as follows:

(a) Explosion plating of the outer surfaces of the containment cylinder 2 and of the outer surfaces of the lid 5 and the bottom 7 with liners or layers of a corrosion inhibiting material such as a titanium-palladium alloy, (b) Explosion plating of the inner surfaces of the bottom and cover plates 8, 6 with layers 18, 19 of the same material, (c) Fitting together of the bottom 7 and the bottom plate 8 and also of the lid 5 and cover plate 6 by placing the explosion welded liners and layers 15 and 18 and also 16 and 19 adjacent one another and welding along the separation seam at the circumference thereof, (d) Threading the bottom plate structure 4 into the lower end of the containment cylinder 2, (e) Welding the two explosion welded liner 15 and layer 18 between the bottom 78 and the bottom plate 8 along their circumference together with the projection 14 of the explosion welded liner 13 protruding at the lower end of the containment cylinder 2, (f) Installing a heat conductive centering sleeve 12 into the containment cylinder 2, (g) Inserting the radioactive body 1 into the centering sleeve 12, (h) Threading the top plug structure 3 consisting of lid 5 and cover plate 6 from the top into the containment cylinder 2, and (i) Welding the outer edges of the explosion welded liner 16 and layer 19 between the lid 5 and cover plate 6 to the upwardly projecting end of the explosion welded liner 13 of the containment cylinder 2.

LISTING OF REFERENCE NUMERALS

1—Container with radioactive content
2—Container cylinder
3—Top plug structure
4—Bottom plug structure
5—Lid
6—Cover plate
7—Bottom
8—Bottom plate
9—Thread
10—Thread
11—Grapping cavity
12—Heat conductive centering sleeve
13—Titanium-palladium liner
14—Projection
15—Titanium-palladium liner
16—Titanium-palladium liner
17—Circumferential faces
18—Titanium-palladium layer
19—Titanium-palladium layer
20—Projection
21—Separating seam
22—Circumferential weld
23—Seam
24—Circumferential weld

We claim:

1. A containment with a corrosion resistant protective cover adapted for the reception of a tightly sealed container with radioactive content such as a steel enclosure containing radioactive waste melted into glass and burnt-out nuclear fuel elements for storage of said container, said containment comprising a metallic hollow containment cylinder, a lid and bottom to be mounted onto opposite ends of said cylinder, corrosion a protective liner completely surrounding said cylinder including said lid and said bottom, a cover plate provided with a corrosion protective layer mounted on said lid with said layer adjacent said liner, and a bottom plate provided with a corrosion protective layer mounted on said bottom with said layer adjacent said liner, each of said cover and bottom plates having a diameter larger than that of the containment cylinder and said corrosion protective liners and layers consisting of the same material which is different from that of which said containment cylinder and said top and bottom plates consist.

2. A containment according to claim 1, wherein said cover and bottom plates and said containment cylinder consist of the same fine-grain construction steel.

3. A containment according to claim 1, wherein the corrosion protective liner and layers on the ouside of said containment cylinder and on said bottom and said lid and on the inner surfaces of said bottom and cover plates are applied by explosion plating.

4. A containment according to claim 3, wherein said corrosion protective liner and layer consist of a titanium-palladium alloy.

5. A containment according to claim 4, wherein the adjacent corrosion liner and layers of said lid and said cover plate and of said bottom and said bottom plate are welded together radially inwardly from the circumference thereof.

6. A containment according to claim 5, wherein the explosion welded layers of the bottom and the cover plates have a larger diameter than the explosion welded liner of the bottom and the lid, and wherein the liner with which said containment cylinder is explosion plated has a greater axial length than said cylinder so that it has axial projections overlapping the liners of the bottom and the lid and after introduction of a container with highly radioactive content into said containment cylinder said cylinder liner is welded from the outside circumferentially together with the abutting layers of said bottom and said cover plates, respectively.

* * * * *